United States Patent [19]

Shapcott

[11] 4,364,580

[45] Dec. 21, 1982

[54] WHEELCHAIR

[75] Inventor: Nigel G. Shapcott, Angus, England

[73] Assignee: The School of Bioengineering and Biophysics of the University of Dundee, Dundee, Great Britain

[21] Appl. No.: 190,896

[22] Filed: Sep. 25, 1980

[30] Foreign Application Priority Data

Sep. 29, 1979 [GB] United Kingdom ..... 7933873

[51] Int. Cl.[3] ..... A61G 5/02

[52] U.S. Cl. ..... 280/266; 280/242 WC; 297/DIG. 4

[58] Field of Search ..... 280/266, 235, 242 WC, 280/289 WC, 87.01; 180/DIG. 3; 297/DIG. 4

[56] References Cited

U.S. PATENT DOCUMENTS

| | | | |
|---|---|---|---|
| 1,269,815 | 6/1918 | Hough | 280/266 X |
| 1,895,737 | 1/1933 | Shaw | 280/87.01 X |
| 2,578,828 | 12/1951 | Nelson | 280/266 |
| 3,872,945 | 3/1975 | Hickman et al. | 180/DIG. 3 |

*Primary Examiner*—John A. Pekar

*Attorney, Agent, or Firm*—Auslander, Thomas & Morrison

[57] ABSTRACT

A wheelchair having at least one pivotal wheel which is steerable in a manner which does not interfere with the manual driving of the wheelchair, by providing a pair of levers linked to the pivotal wheel or wheels and actuable by movement of the upper body of a user of the chair, each lever being movable to steer the wheelchair in one respective direction only.

8 Claims, 6 Drawing Figures

WHEELCHAIR

This invention relates to a wheelchair.

Conventional wheelchairs are manually propelled by gripping annular tubes disposed adjacent the periphery of and concentric with a pair of large driving road wheels and exerting a force thereon in the intended direction of travel. This means of propulsion limits the extent of directional control which can be placed on the wheelchair, and in general steering is performed by exerting a greater force on the annular tube on one side of the wheelchair than on the other. Small castor wheels are provided to allow this differential force to result in change of direction. However, the presence of these castor wheels allows outside agencies such as road camber to alter the direction of travel of the wheelchair even when not desired; the castor wheels tend to adopt an attitude in which they are aligned down a gradient. To keep a wheelchair in a straight line across a gradient therefore involves considerable effort in propelling the driving wheel on the lower side of the gradient to a greater extent than the opposite driving wheel.

In spite of this problem no effective steering system for a wheelchair has previously been proposed, one of the difficulties being that the wheelchair user's hands are occupied in propelling the vehicle and cannot therefore be employed fully for steering.

According to the present invention there is provided a wheelchair having a frame, a seat on the frame, road wheels mounted on axles on the frame, at least one of the road wheels being pivotal about an axis normal to its axis of rotation, and a steering mechanism for the pivotal road wheel operable by movement of a lever mounted on the frame and arranged to be actuated by movement of the upper body of an occupant of the seat.

It has been found that by operating the steering mechanism by movement of the upper part of the body the function of the hands and arms in propelling the wheelchair is not affected. A preferable situation for the lever is to lie between the chest and an arm of the occupant, and the lever itself can be in the form of a pad to reduce chafing and other discomfort. When the lever is mounted so as to pivot about a generaly horizontal axis running fore-and-aft of the wheelchair the force exerted by a user on the lever does not result in loss of sideways support, and this arrangement therefore has considerable advantages.

There are advantages in providing a flexible linkage between the actuating lever for the steering mechanism and its associated pivotal road wheel. For example, a flexible linkage can be tied to the frame along its length for compactness, and can be freed at will for repair or redirecting if required; thus accessories can be mounted on the frame and the linkage simply re-routed around them without the need for dismantling and reconstructing the linkage. A suitable type of such flexible linkage is a Bowden cable in which an inner control cable is slidable within a flexible sheath fixed at its ends.

In order to provide steering in both directions, a pair of levers is provided with each lever being operable to bias the direction of travel to one respective side only; thus the movement of one lever causes a turn towards the right only, movement of the other lever causing a turn to the left only. Return of each lever to its starting position need not result in a corresponding turn of the pivotal wheel, so that positive steering is achieved only by movement of the lever away from its starting position. In the two-lever system, return of the wheelchair to its straight-line bias would be achieved either by movement of the opposite lever (resulting in an initial bias in the opposite direction) or simply by continuing to exert equal force on the driving wheels.

In one embodiment of the invention two pivotal road wheels are provided and the levers are linked one with each said wheel, so that positive bias in a given lateral direction is achieved by pressing on one lever to cause the corresponding pivotal road wheel to turn.

It is convenient for the wheelchair to be operated as in conventional arrangements, for which purpose the steering mechanism can be disengageable from its pivotal road wheel, for example by means of a dog clutch in the linkage.

Embodiments of the invention will now be described by way of example with reference to the accompanying drawings in which.

Figure 1:
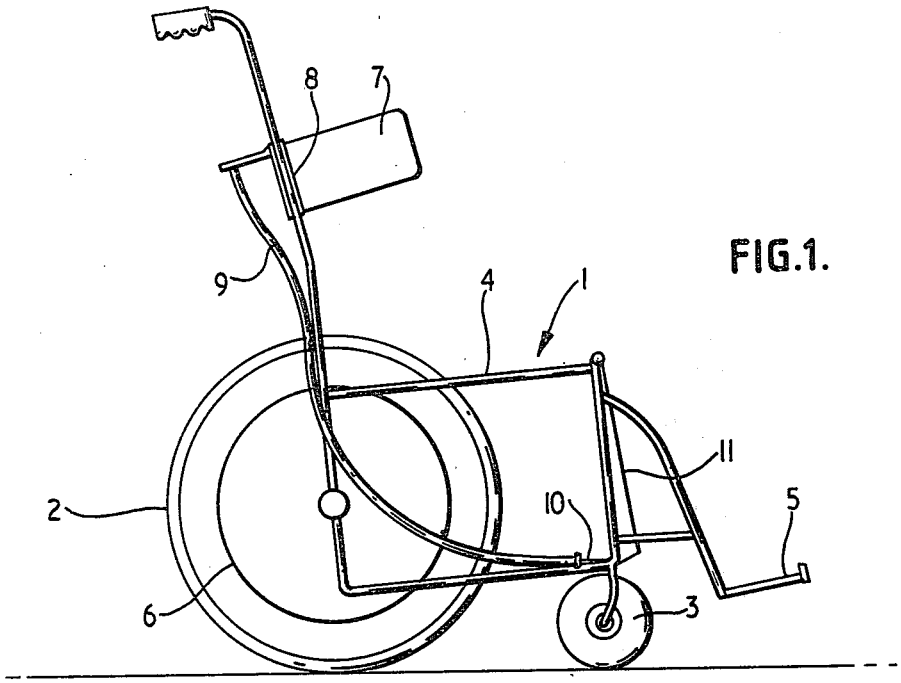
FIG. 1 is a schematic side view of a wheelchair of this invention.
Figure 2:
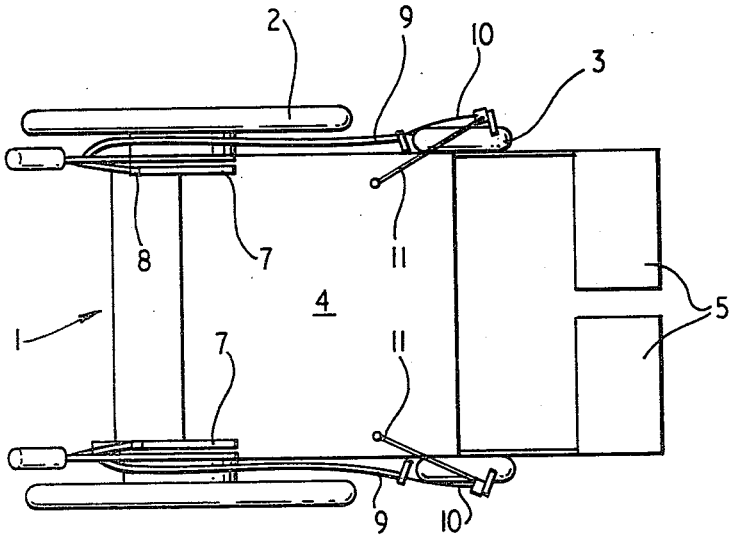
FIG. 2 is a plan view corresponding to FIG. 1.

The wheelchair of FIGS. 1 and 2 has a conventional structure of a frame generally indicated at 1 with a pair of large driving road wheels 2 on the rear of the frame 1 and a pair of small castor wheels 3 pivotally mounted at the front of the frame 1. The frame 1 carries a seat 4 and a pair of pivotal footrests 5.

The rear wheels 2 have manual driving members in the form of annular metal tubes 6 secured to them concentrically, and the wheelchair is driven by an occupant of the seat gripping these tubes and exerting a forward force on them.

At an upper portion of the frame 1 are a pair of padded levers 7 pivotally mounted about an upright axis 8, the levers 7 being arranged so as to engage the side of an occupant's chest, and for this purpose they may be movable up or down the frame 1. The levers 7 each actuate a Bowden cable 9 secured between the lever 7 and a corresponding castor wheel 3 as shown in FIG. 2, in a manner whereby pivoting of the lever outwardly causes the inner cable 10 to be tensioned.

A castor lock operating lever 11 is provided on the front of the frame 1, movable up or down to release or engage respectively the Bowden cable 9 from the castor wheel 3.

Thus under normal conditions when the wheelchair is travelling along a level road with no camber the operating lever 11 is in its upper position so that the castor wheels 3 are free to follow the direction of travel dictated by the manual force on the driving wheels 2. When a side gradient is encountered, or if steering is otherwise required, the operating lever 11 is pushed down to engage the Bowden cables 9 with the castor wheels 3, and the wheelchair can then be steered while exerting equal force on both driving wheels 2 by the occupant moving his or her upper body sideways in the desired direction of travel. This pivots one of the levers 7 about its axis 8, tensioning the Bowden cable 9 which turns or biasses the corresponding castor wheel 3. The other castor wheel 3 will naturally follow the resulting direction of turn or bias.

Figure 3:
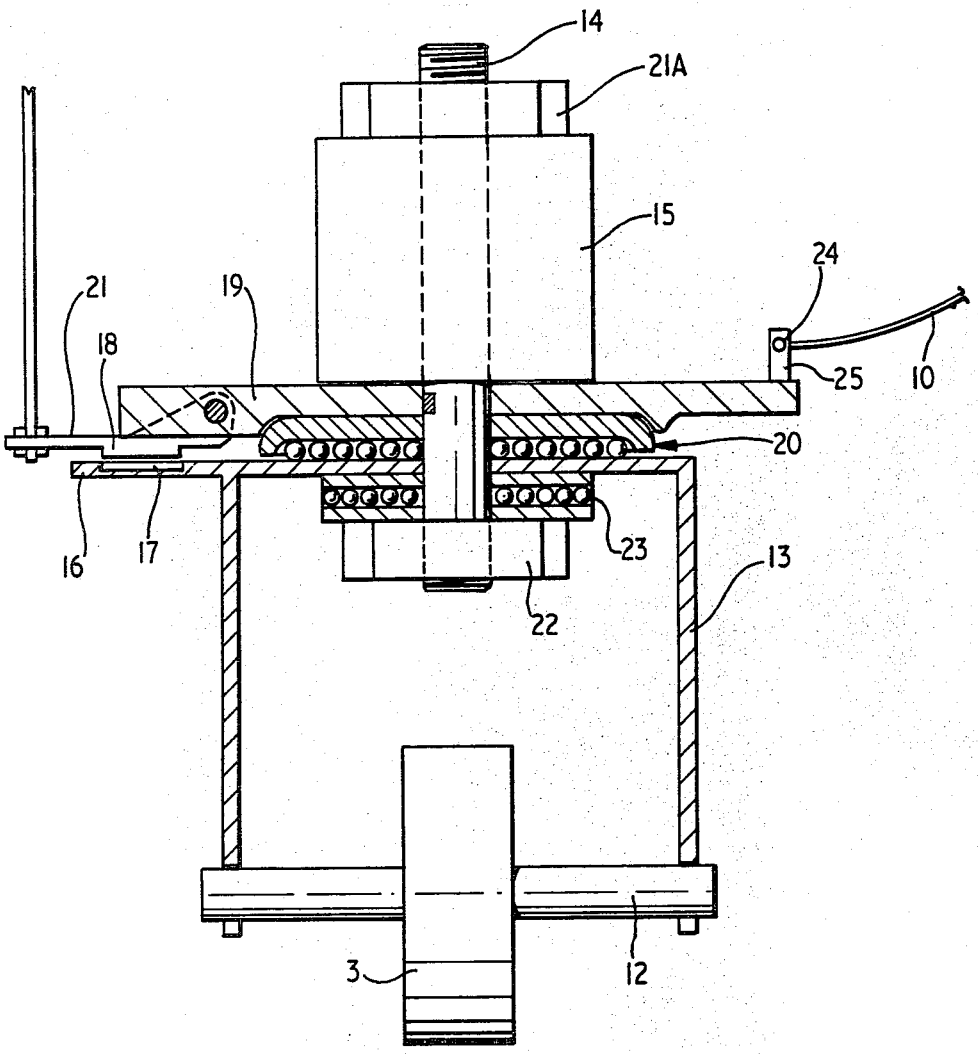
FIG. 3 is a part-sectional front view of the lower end of a steering mechanism on a wheelchair of the invention.
Figure 4:
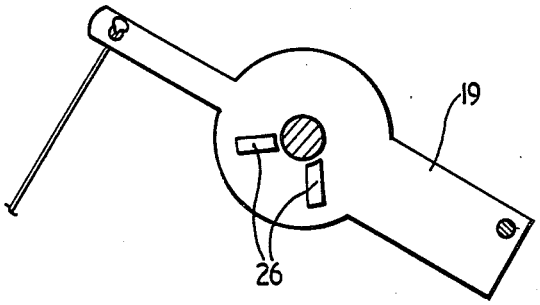
FIG. 4 is a plate used in the arrangement of FIG. 3.

The construction of the lower end of one particular steering mechanism is shown in FIGS. 3 and 4. The castor wheel 3 is mounted on an axle 12 connected to a fork member 13 which is freely rotatable on a stub shaft 14. This shaft 14 is rotatable in axial and thrust bearings (not shown) within a housing 15 on the frame 1. The fork member 13 has an extension plate 16 recessed at 17, the recess corresponding with a projection 18 on a lever arm 21 pivoted on a plate 19. The plate 19 is keyed to a shaft 14. A ball bearing 20 is disposed between the fork member 13 and the plate 19.

The assembly is held on the shaft 14 between two nuts 21A and 22, with a ball bearing 23 between the nut 22 and the fork member 13.

The lever arm 21 is connected at its free end to the operating lever 11 actuation of which causes the arm 21 to pivot, taking the projection 18 into or out of engagement with the recess 17 so that the plate 19 and fork member 13 are locked together or released from one another respectively.

The Bowden cable 9 has its inner cable 10 passing through a hole 24 through a spur 25 on the plate 19 so that when tensioned the cable 10 pulls the spur 25, causing the plate 19 and the shaft 14 to rotate.

Thus when the operating lever 11 is in its downward position, locking the plate 19 and fork member 13 together, tensioning the Bowden cable 9 rotates the fork member 13 in one direction, and therefore also the castor wheel 3. Release of tension in the cable 9 allows the wheel 3 to rotate freely.

A pair of projecting stop members 26 on the plate 19 upper face (FIG. 4) are engageable with a projection (not shown) on the underside of the housing 15 to limit the free rotation of the plate 19 to facilitate engagement of the dog clutch mechanism of the projection 18 and recess 17.

Figure 5:
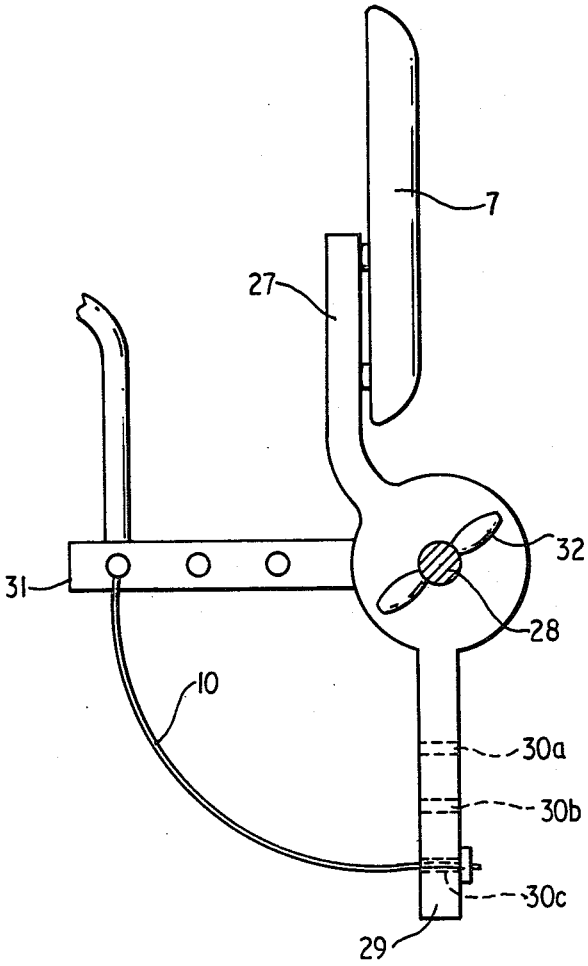
FIG. 5 is a front view of the upper end of a steering mechanism on a wheelchair of the invention.

Referring now to FIG. 5, the padded lever 7 is bolted or rivetted to a bracket 27 rotatably mounted on a shaft 28 fixed to the frame. The bracket 27 has an arm 29 apertured at 30*a*, 30*b* and 30*c* to receive the upper end of the Bowden inner cable 10. The outer sheath is secured to a fixed extension 31 on the frame. A wing nut 32 retains the bracket 27 on the shaft 28. Thus anticlockwise movement of the lever 7 rotates the bracket 27 on the shaft 28, tensioning the cable 10.

Figure 6:
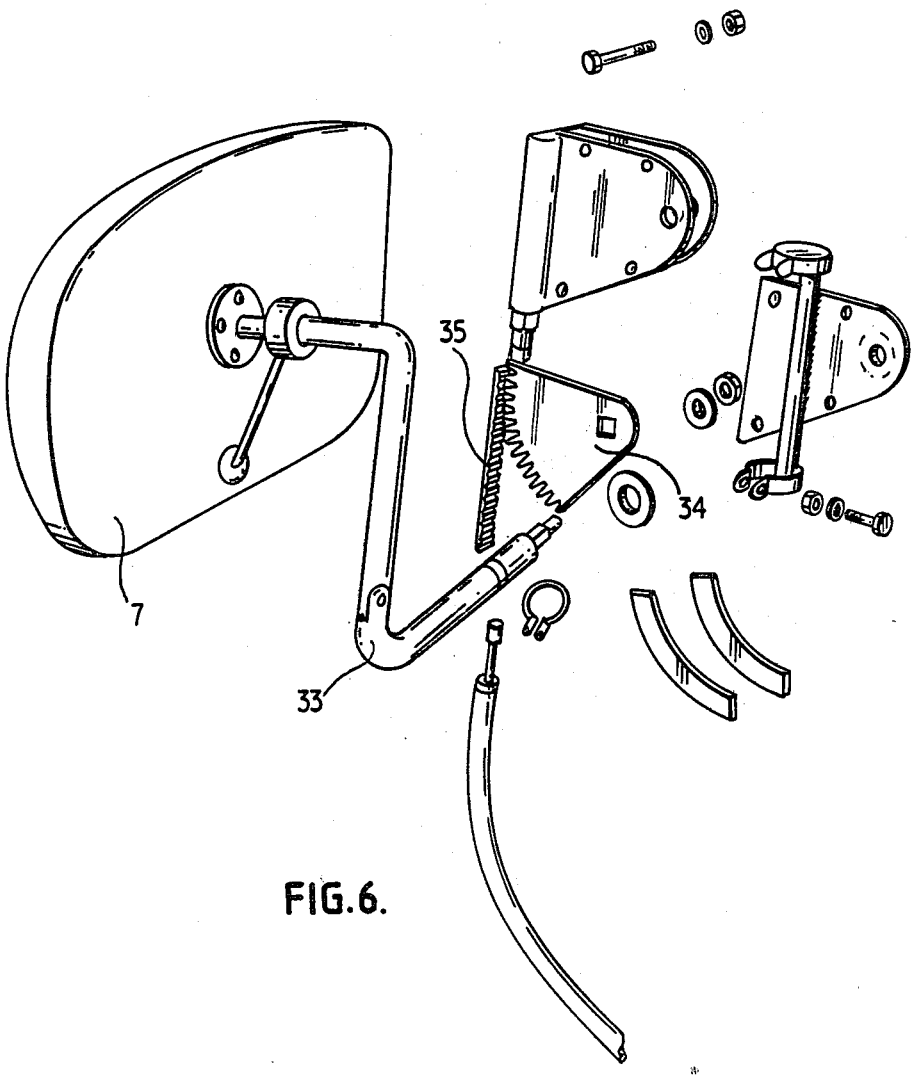
FIG. 6 is a perspective exploded view of an alternative upper end of a steering mechanism.

FIG. 6 shows an alternative arrangement to FIG. 5. The lever 7 is mounted on a crank arm 33 secured at its other end to a plate 34 forming one part of a ratchet mechanism. The other part is a shaft 35 which holds the upper end of the Bowden inner cable 10. Thus clockwise movement of the lever 7 moves the plate 34 to raise the shaft 35, tensioning the cable 10.

In other embodiments the actuating mechanism for the Bowden cable can be disposed rearwardly of the seat of the wheelchair, rather than alongside it, so as not to restrict the lever 7 movement.

Modifications and improvements may be made without departing from the scope of the invention.

I claim:

1. A wheelchair having a frame, a seat on the frame, road wheels mounted on axles on the frame, two of the road wheels being pivotal independently of one another about axes normal to their respective axes of rotation, and steering mechanisms one for each of the pivotal road wheels and independent of one another, the steering mechanisms arranged to be actuated by movement of the upper body of an occupant of the seat, one of the steering mechanisms having a lever actuatable to pivot its respective pivotal road wheel in one direction only and the other steering mechanism having a lever actuatable to pivot its respective pivotal road wheel in the opposite direction only, the pivotal road wheels being otherwise freely pivotal.

2. A wheelchair according to claim 1, wherein the levers are each pivotal about a generally horizontal axis running fore-and-aft of the chair.

3. A wheelchair according to claim 1 or 2, wherein the levers are each in the form of a pad pivotally mounted on the frame and arranged to lie between the chest and a respective arm of an occupant of the seat.

4. A wheelchair according to claim 1 or 2, wherein the steering mechanism includes a flexible linkage between the lever and the pivotal road wheel.

5. A wheelchair according to claim 4, wherein the flexible linkage is a Bowden cable.

6. A wheelchair according to claim 1 or 2, wherein means are provided for selectively disengaging the steering mechanism from the pivotal road wheel.

7. A wheelchair according to claim 6, wherein said means is a dog clutch.

8. A wheelchair according to claim 1, wherein one of the levers and its pivotal road wheel are both mounted at the left-hand side of the frame and the lever is actuated by movement to the left to cause its road wheel to pivot to the left, while the other lever and its pivotal road wheel are both mounted at the right-hand side of the frame and the lever is actuated by movement to the right to cause its road wheel to pivot to the right.

* * * * *